US008013582B2

(12) United States Patent
Yamada et al.

(10) Patent No.: US 8,013,582 B2
(45) Date of Patent: Sep. 6, 2011

(54) VOLTAGE CONTROL CIRCUIT

(75) Inventors: Kazuhiko Yamada, Tokyo (JP); Shigemitsu Horikawa, Saitama (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 548 days.

(21) Appl. No.: 12/236,556

(22) Filed: Sep. 24, 2008

(65) Prior Publication Data

US 2009/0096438 A1 Apr. 16, 2009

(30) Foreign Application Priority Data

Oct. 10, 2007 (JP) ..... 2007-263954

(51) Int. Cl.
*G05F 1/00* (2006.01)
*G05F 3/04* (2006.01)

(52) U.S. Cl. ..... 323/273; 323/311

(58) Field of Classification Search ..... 323/907, 323/275, 276, 303, 273, 272, 304, 313, 311, 323/274, 312, 314, 279, 281; 327/540, 539
See application file for complete search history.

(56) References Cited

U.S. PATENT DOCUMENTS

| | | | | |
|---|---|---|---|---|
| 4,091,321 | A * | 5/1978 | Hanna | 323/314 |
| 4,322,676 | A * | 3/1982 | Toyoda | 323/303 |
| 4,797,577 | A * | 1/1989 | Hing | 327/539 |
| 5,864,226 | A * | 1/1999 | Wang et al. | 323/273 |
| 6,525,596 | B2 * | 2/2003 | Hosono et al. | 327/540 |
| 7,227,343 | B2 * | 6/2007 | Jiang et al. | 323/274 |
| 7,573,324 | B2 * | 8/2009 | Kuwano | 327/540 |

FOREIGN PATENT DOCUMENTS

| | | |
|---|---|---|
| JP | 05-250048 | 9/1993 |
| JP | 2006-127093 | 5/2006 |
| JP | 2006-202146 | 8/2006 |
| JP | 2009-93446 | 4/2009 |

* cited by examiner

*Primary Examiner* — Gary L Laxton
*Assistant Examiner* — Zekre A Tsehaye
(74) *Attorney, Agent, or Firm* — Taft Stettinius & Hollister LLP

(57) ABSTRACT

A voltage control circuit accepts an input voltage and produces a regulated output voltage. Embodiments provide improved responsiveness to variations in input voltage, load current, and ambient temperature. Exemplary embodiments include an NPN transistor connected between the input and output terminals, which is controlled by a feedback circuit. In an embodiment, the feedback circuit includes a PMOS transistor and in another embodiment the feedback circuit includes a PNP transistor.

6 Claims, 3 Drawing Sheets

VOLTAGE CONTROL CIRCUIT

CROSS-REFERENCE TO RELATED APPLICATION

This application claims priority under 35 U.S.C. §119 to Japanese patent application Serial Number 2007263954, filed on Oct. 10, 2007, the disclosure of which is incorporated herein by reference.

BACKGROUND

This disclosure relates to a voltage control circuit for generating and outputting a constant DC voltage from an input DC voltage.

FIGS. 2(*a*) and 2(*b*) are block diagrams of conventional voltage control circuits. In FIG. 2(*a*), the voltage control circuit includes an NPN-type transistor (hereinafter referred to as "NPN") 23 having a collector connected to an input terminal 21 and an emitter connected to a output terminal 22. A resistor 24 is connected between the collector and a base of the NPN 23, as is described in Japanese Patent Application Laid Open Publication No. 2006-127093, which is incorporated by reference. The base of the NPN 23 is connected to the ground voltage GND through the NPN 25 and Zener diode 26, which are serially connected. In addition, the base of the NPN 25 is connected to an output terminal 22, and the emitter of the NPN 25 is connected to the output terminal 22 through a resistor 27.

In the voltage control circuit of FIG. 2(*a*), when an input voltage VI is applied to the input terminal 21, a current starts to flow through the resistor 24 to turn on the NPN 23, causing an output voltage VO at the output terminal 22. As a result, a Zener current flows through the Zener diode 26 through the resistor 27. Since the base-emitter voltage ($V_{BE}$) of the NPN 25 is approximately 0.6V of constant voltage, a current flowing through the resistor 27 becomes a constant value corresponding to the resistance of the resistor 27. Consequently, the emitter voltage of the NPN 25 becomes the Zener voltage arising at the Zener diode 26 by the constant Zener current. Therefore, the output voltage VO becomes a sum voltage of the Zener voltage of the Zener diode 26 and the base remitter voltage $V_{BE}$ of the NPN 25, and then a constant output voltage VO can be obtained independently from the value of a load connected to the output terminal 22.

Additionally, in FIG. 2(*b*), the voltage control circuit includes a PNP-type transistor (hereinafter referred to as "PNP") 33 having an emitter connected to the input terminal 31, a collector connected to an output terminal 32, and a base connected to a collector of a NPN 35 through a resistor 34, as is described in Japanese Patent Application Laid Open Publication No. H5-250048, which is incorporated by reference. The emitter of the NPN 35 is connected to a current limiter 37 through Zener diode 36. A voltage divider, including resistors 38, 39, is connected between the output terminal 32 and the ground voltage GND, and the output voltage VO is divided by the voltage divider to be provided to an error amplifier 40. The error amplifier 40 outputs a voltage corresponding to the differential between the divided voltage of the output voltage VO and a reference voltage REF, and the voltage is provided to the base of the NPN 35 through a resistor 41.

In the voltage control circuit of FIG. 2(*b*), the output voltage VO divided by the voltage divider and the reference voltage REF are compared with each other by the error amplifier 40, and the collector current of the NPN 35, used as a driving current, is controlled based on the result of the comparison. The collector current of the NPN 35 controls the base current of the PNP 33, which is used for controlling the voltage, so that the output voltage VO becomes proportional to the reference voltage REF. Consequently, the output voltage VO can be maintained at a constant voltage while the load connected to the output terminal 32 is varied and while the input voltage VI is varied.

Japanese Patent Application Laid Open Publication No. 2006-202146, which is incorporated by reference, also provides background to the present disclosure.

In the voltage control circuit of FIG. 2(*a*), the Zener current flowing through the Zener diode 26 is not only the current flowing through the resistor 27 from the output terminal 22, but also includes the current flowing through the resistor 24 and the NPN 25 from the input terminal 21. Consequently, in the case where the input voltage VI is constant, the Zener current becomes approximately constant and a stable output voltage VO can be obtained; however, in the case where the input voltage VI varies, the Zener current varies and the Zener voltage varies. Accordingly, the output voltage VO is influenced by variation of the input voltage VI.

In the voltage control circuit of FIG. 2(*b*), the stable output voltage VO can be obtained independently from the variations of the input voltage VI and variations of the load current; however, since the error amplifier 40 and a circuit for generating the reference voltage REF are necessary, a larger circuit may be required. In addition, since the supply voltage of the error amplifier 40 is provided from the input voltage VI, when a high input voltage VI (for example, 24V) is applied, an error amplifier 40 having a high voltage rating becomes necessary.

SUMMARY

Embodiments described herein include voltage control circuits accepting an input voltage and producing a regulated output voltage. Embodiments provide improved responsiveness to variations in input voltage, output voltage, and ambient temperature. Exemplary embodiments include an NPN transistor connected between the input and output terminals, which is controlled by a feedback circuit. In an embodiment, the feedback circuit includes a PMOS transistor and in another embodiment the feedback circuit includes a PNP transistor.

In a first, aspect, an exemplary voltage control circuit includes a first transistor having a collector connected to an input terminal provided with an input voltage, an emitter connected to an output terminal outputting a controlled voltage, and a base connected to a first node; a first resistor connected between the input terminal and the first node; a second resistor connected between the first node and a second node; a second transistor having a collector connected to the second node, and an emitter connected to a third node; a third transistor diode-connected in a forward direction between the third node and a fourth node; a third resistor connected between the fourth node and a ground voltage; a fourth resistor connected between the output terminal and a base of the second transistor; a fifth resistor connected between the base of the second transistor and the ground voltage; and a fourth transistor connected between the first node and the ground voltage, the fourth transistor having a conductive stale controlled by a voltage of the second node.

In a detailed embodiment of the first aspect, the third transistor may include a plurality of bipolar transistors connected serially, each of the plurality of bipolar transistors being diode-connected in a forward direction.

In another detailed embodiment of the first aspect, the fourth transistor may be a MOS transistor having a source connected to the first node, a gate connected to the second node, and a drain connected to the ground voltage. Further, the third transistor may include a plurality of bipolar transistors connected serially, each of the plurality of bipolar transistors being diode-connected in a forward direction.

In another detailed embodiment of the first aspect, the fourth transistor may be a bipolar transistor having an emitter connected to the first node, a base connected to the second node, and a collector connected to the ground voltage. In a further detailed embodiment, the third transistor may include a plurality of bipolar transistors connected serially, each of the plurality of bipolar transistors being diode-connected in a forward direction.

From the foregoing summary and the following detailed description of various exemplary embodiments, it will be apparent to those skilled in the art that the present disclosure provides a significant advance in the art of voltage control circuits. Additional features and advantages of various exemplary embodiments will be better understood in view of the detailed description provided below.

BRIEF DESCRIPTION OF THE DRAWINGS

This disclosure will be understood and appreciated more fully from the detailed description in conjunction with the following drawings in which:

FIG. 2(*b*) is a block diagram of a second conventional voltage control circuit.

DETAILED DESCRIPTION

It will be apparent to those skilled in the art that many uses and variations arc possible for the systems and methods described herein. The following detailed description includes various exemplary embodiments. Other embodiments will be apparent to those skilled in the art given the benefit of this disclosure. The drawings are merely exemplary, and are not intended to limit the scope of the present disclosure.

Figure 1:
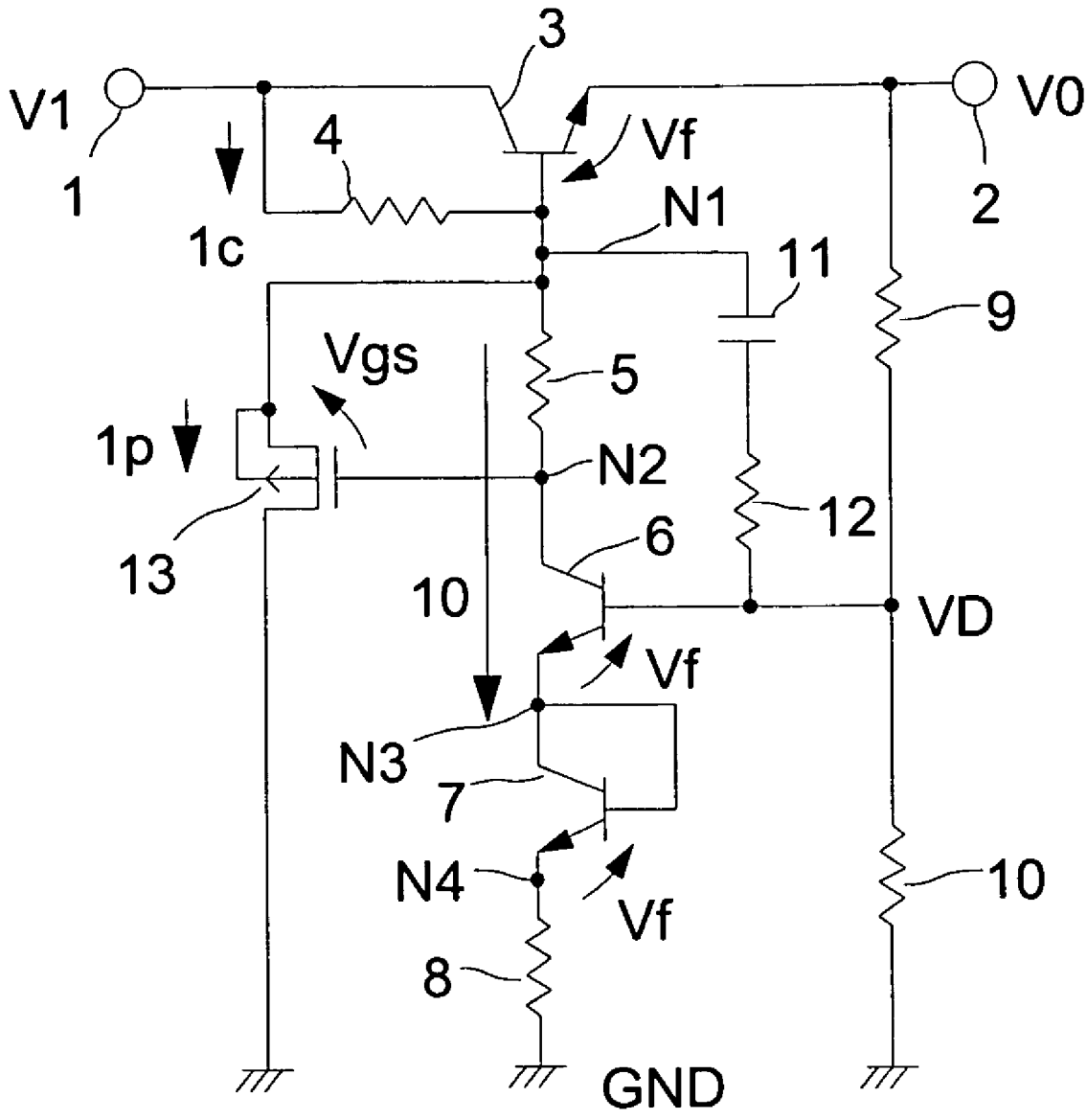
FIG. 1 is a block diagram of a first exemplary voltage control circuit.
Figure 2A:
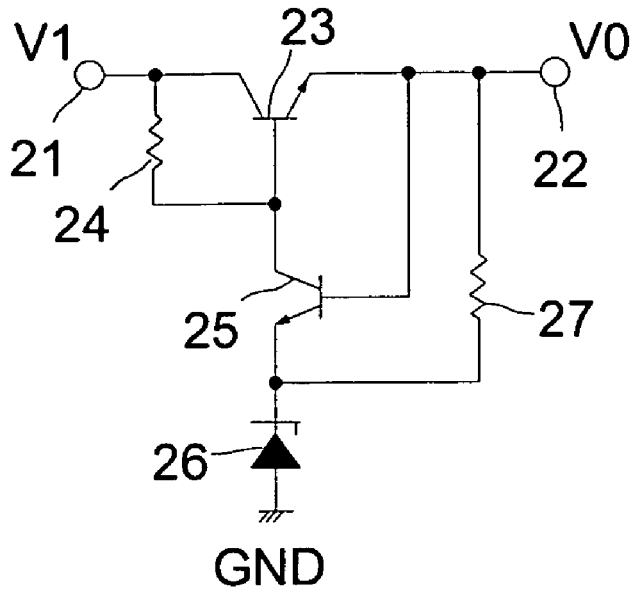
FIG. 2(a) PRIOR ART
FIG. 2(*a*) is a block diagram of a first conventional voltage control circuit.
Figure 2B:
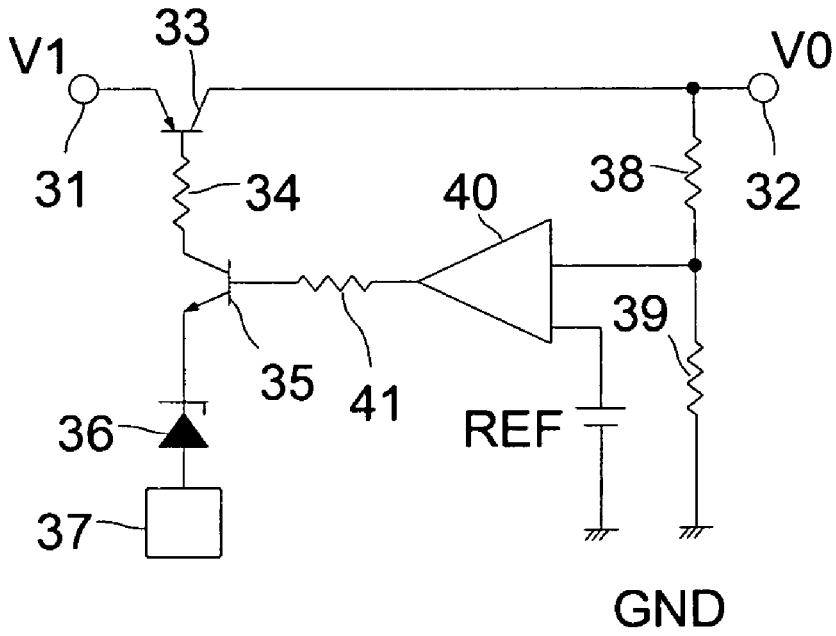
FIG. 2(b) PRIOR ART

FIG. 1 is a block diagram of a voltage control circuit according to a first exemplary embodiment. The exemplary voltage control circuit may be used as a power supply circuit for supplying a stable lower voltage to logic circuits and/or other components operated at 5V, for example, in an electronic apparatus operated at a higher main power supply voltage of, for example, 24V.

The voltage control circuit 6f FIG. 1 includes an NPN 3 having a collector connected to an input terminal 1 provided with a main power supply voltage of the input voltage VI, and an emitter connected to an output terminal 2 outputting a stable lower voltage of an output voltage VO. The base of the NPN 3 is connected to the node N1, and a resistor 4 is connected between the above node N1 and the input terminal 1. Furthermore, one end of a resistor 5 is connected to the node N1, and the other end of the resistor 5 is connected to a node N2. In addition, the collector of the NPN 6 is connected to the node N2, and the emitter of the NPN 6 is connected to a node N3. The collector and base of a NPN 7 are diode-connected to each other in a forward direction and are connected to the node N3. (A "diode-connected" transistor is a transistor in which two terminals are shorted to give diode action. NPN 7 is referred to as "forward connected" because its collector and base are shorted.) The emitter of the NPN 7 is connected to a node N4, and the node N4 is connected to the ground voltage GND through a resistor 8.

A voltage divider includes resistors 9, 10, and is connected between the output terminal 2 and the ground voltage GND. A voltage VD is provided to the base of the NPN 6. In addition, a phase compensation circuit for preventing oscillation and including a capacitor 11 and a resistor 12 is connected between the node N1 and a base of the NPN 6.

Furthermore, a source of a P-channel MOS (metal-oxide semiconductor) transistor (hereinafter referred to as "PMOS") 13 is connected to the-node N1, and a drain of the PMOS 13 is connected to the ground voltage GND. The gate of the PMOS 13 is connected to the node N2.

The voltage control circuit of FIG. 1 operates as follows: If the voltage inputted to the input terminal 1 is VI, the voltage outputted from the output terminal 2 is VO, the resistance of the resistor 4 is R4, and the current flowing through the resistor 4 is Ic, then the current Ic is given by the following formula (1):

$$Ic=(VI-(VO+Vf))/R4 \quad (1)$$

In addition, if the current flowing through the resistor 5 is $I_O$, the current flowing through the PMOS 13 is Ip, and the base current of the NPN 3 is neglected, then the relationship between Ic, $I_O$, and Ip is given by the following formula (2):

$$Ic=I_O+I_p \quad (2)$$

A current Ip flowing through the PMOS 13 is generally given by the flowing formula (3):

$$Ip=K(Vgs-Vt)^2 \quad (3)$$

In the above formula, K is a constant, Vgs is a gate-source voltage of the PMOS 13, Vt is a threshold voltage. Since Vgs is the voltage across resistor 5, if the resistance of the resistor 5 is R5, then Vgs=R5×$I_O$. Consequently, the formula (3) is changed to the formula (4).

$$Ip=K(R5\times I_O-Vt)^2 \quad (4)$$

Meanwhile, since a voltage VD applied to a base of the NPN 6 is obtained by dividing the output voltage VO by resistors 9, 10, if resistances of the resistors 9, 10 are R9 and R10, respectively, then the voltage VD is given by the following formula (5).

$$VD=VO\times R10/(R9+R10) \quad (5)$$

Furthermore, since the voltage VD equals the sum of the base-emitter voltages of the NPNs 6, 7 and the voltage across resistor 8, if a resistance of the resistor 8 is R8, then the voltage VD is given by the following formula (6).

$$VD=2\times Vf+R8\times I_O \quad (6)$$

Consequently, the required output voltage VO is outputted corresponding to the input voltage VI by setting appropriately the resistances of R4, R5, R8 to R10 based on the formulas (1) to (6).

Variations of the output voltage VO in the case where the load current, the input voltage, and the temperature vary in the above voltage control circuit are discussed below.

(A) Variation of the Load Current

In the voltage control circuit depicted in FIG. 1, when the output voltage VO falls (by an increase in the load current, for example) voltage VD also falls. Consequently, the base voltage of the NPN 6 falls, and the current $I_O$ flowing through the NPN 6 decreases. As a result, the current Ic flowing through the resistor 4 decreases, and the base voltage of the NPN 3 rises. Accordingly, the emitter current of the NPN 3 increases and the output voltage VO rises so as to control the output voltage to the required voltage.

Meanwhile, when the output voltage VO rises (by a decrease, of the load current, for example) the voltage VD correspondingly rises to raise the base voltage Of the NPN 6, and the current $I_O$ flowing through the NPN 6 increases. Accordingly, the current Ic flowing through the resistor 4 also increases to reduce the base voltage of the NPN 3, and the emitter current of the NPN 3 decreases. Consequently, the output voltage VO falls so as to control the voltage to the required output voltage VO.

(B) Variation of the Input Voltage

When the required output voltage VO is produced corresponding to a given input voltage VI, when the input voltage VI rises, the current Ic flowing through the resistor 4 increases, as given by formula (1). Then, the current Ic is divided to current $I_O$ (through the resistor 5) and current Ip (through the PMOS 13). When the current $I_O$ through the resistor 5 increases due to an increase in the input voltage VI, a gate-source voltage Vgs of the PMOS 13 increases to reduce an on-resistance of the PMOS 13. Consequently, the current Ip through the PMOS 13 increases to restrain the variation (increase) of the current $I_O$.

Meanwhile, when the input voltage falls, the current Ic through the resistor 4 decreases. When the current $I_O$ through the resistor 5 decreases due to a decrease of the current Ic, the gate-source voltage Vgs of the PMOS 13 decreases to increase the on-resistance of the PMOS 13. Consequently, the current Ip through the PMOS 13 decreases to restrain the variation (decrease) of the current $I_O$.

As discussed above, since the variation of the current Ic caused by the variation of the input voltage VI can be absorbed by the PMOS 13 connected in parallel to the current path of the current $I_O$ (the resistor 5, the NPNs 6, 7, and the resistor 8), the variation of the current $I_O$ can be restrained and the variation of the output voltage VO can be restrained, as well.

(C) Variation of Temperature

Generally, as temperature rises, the reverse saturation current of a bipolar transistor increases and the base-emitter voltage Vf decreases. Meanwhile, as a temperature rises, the resistance of a resistor increases.

In the voltage control circuit of FIG. 1, when the ambient temperature rises, the base-emitter voltages Vf of the NPNs 6, 7 decrease and the resistance R8 of the resistor 8 simultaneously increases, and then the voltage drop across the resistor 8 increases. When the ambient temperature falls, the base-emitter voltages Vf of the NPNs 6, 7 increase and the resistance R8 of the resistor 8 simultaneously decreases, and then the voltage drop across the above resistor 8 decreases.

Consequently, since a negative temperature coefficient of the base-emitter voltage Vf and positive temperature characteristics of the voltage drop caused by the resistor 8 cancel each other, the temperature variation of the voltage VD is restrained to suppress the variation of the current $I_O$, and, accordingly, the variation of the output voltage VO is restrained. In particular, the output voltage VO may be made immune to temperature variations by selecting one or more of the serially diode-connected NPNs 7 and the resistance R8 of the resistor 8 so that the temperature coefficient becomes zero.

As discussed above, the voltage control circuit of FIG. 1 is configured so that the current Ip through the PMOS 13 is controlled based on the current $I_O$ by connecting the PMOS 13 in parallel with the path of the current $I_O$ (the resistor 5, the NPNs 6, 7, and the resistor 8). By employing such a configuration, when the current $I_O$ increases, most of the increased current is divided to the PMOS 13 as the current Ip, and when the current $I_O$ decreases, the decreased current is returned back from the current Ip to the current $I_O$ side. Consequently, the current $I_O$ can be maintained approximately constant independently of the variation of the input voltage VI and a constant output voltage VO can be outputted by the simplified circuit configuration.

Furthermore, since the control voltage VD is generated by serially connecting the NPNs 6, 7 and the resistor 8, which have complementary characteristics to each other, respectively, a constant output voltage VO immune to changes in the ambient temperature can be obtained.

Figure 3:
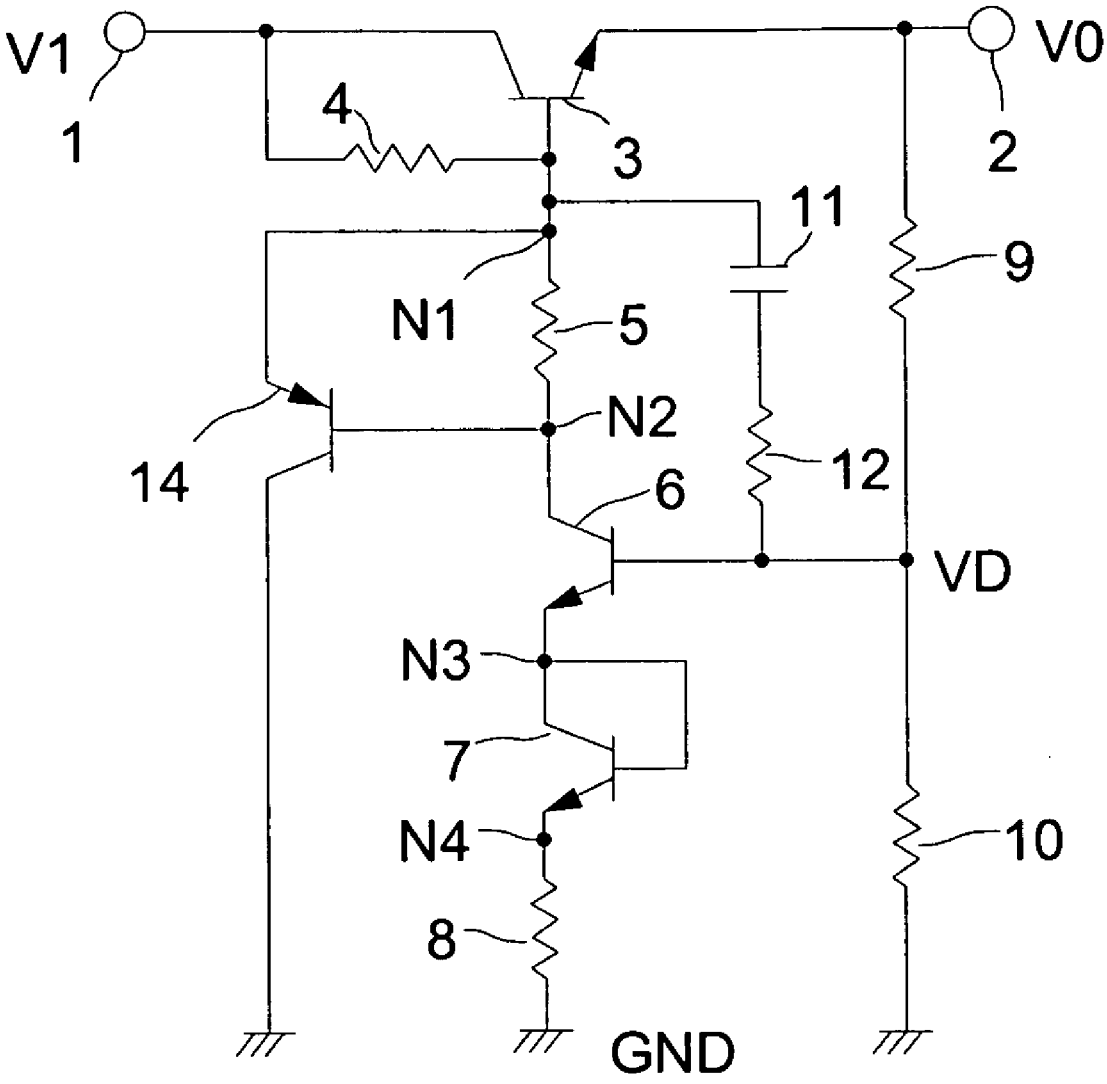
FIG. 3 is a block diagram of a second exemplary voltage control circuit.

FIG. 3 is a block diagram of a voltage control circuit according to a second exemplary embodiment. In general, the elements identical to those ones in FIG. 1 are given the same numerals as in FIG. 1.

The voltage control circuit of FIG. 3 is configured to use a PNP-type transistor (hereinafter referred to as "PNP") instead of the PMOS 13 of FIG. 1. The emitter of the PNP 14 is connected to the node N1, the collector is connected to the ground voltage, and the base is connected to the node N2. Other configurations are generally the same as in FIG. 1.

Operations of the voltage control circuit of FIG. 3 are basically the same as those described above for the voltage control circuit of FIG. 1. However, since the PNP bipolar transistor 14 is used instead of the PMOS 13, there is ah advantage that the sensitivity to restrain the variation of the output voltage VO can be improved compared with the circuit shown in FIG. 1, and the temperature characteristics can be improved as well.

The present disclosure is not limited to the aforementioned exemplary embodiments, and various modifications are possible. For example, several exemplary modifications are described below:

(a) The circuit configuration for the case in which the input voltage VI and the output voltage VO are positive is shown; however, in a case where the input voltage VI and the output voltage VO are negative, the same configuration is possible by reversing the transistor conductive type (for example, using a PNP type instead of an NPN type).

(b) The component depicted as the diode-connected NPN 7 is not limited to a single NPN transistor, and embodiments may include a plurality of serially connected NPNs 7 corresponding to a required output voltage VO.

(c) A phase compensation circuit for preventing oscillation (such as the capacitor 11 and the resistor 12) can be added as heeded.

Following from the above description and invention summaries, it should be apparent to persons of ordinary skill in the art that, while the systems herein described constitute exemplary embodiments, it is to be understood that this disclosure is not limited to the above precise embodiments and that changes may be made without departing from the scope of the claims. Likewise, it is to be understood that the invention is defined by the claims and it is not necessary to meet any or all of the identified advantages or objects of the invention disclosed herein in order to fall within the scope of the claims, since inherent and/or unforeseen advantages of the present invention may exist even though they may not have been explicitly discussed herein.

What is claimed is:

1. A voltage control circuit comprising:

a first transistor having a collector connected to an input terminal provided with an input voltage, an emitter connected to an output terminal outputting a controlled voltage, and a base connected to a first node;

a first resistor connected between the input terminal and the first node;

a second resistor connected between the first node and a second node;

a second transistor having a collector connected to the second node, and an emitter connected to a third node;

a third transistor diode-connected in a forward direction between the third node and a fourth node;

a third resistor connected between the fourth node and a ground voltage;

a fourth resistor connected between the output terminal and a base of the second transistor;

a fifth resistor connected between the base of the second transistor and the ground voltage; and a fourth transistor connected between the first node and the ground voltage, the fourth transistor having a conductive state controlled by a voltage of the second node.

2. The voltage control circuit of claim 1, wherein the third transistor includes a plurality of bipolar transistors connected serially, each of the plurality of bipolar transistors being diode-connected in a forward direction.

3. The voltage control circuit of claim 1, wherein the fourth transistor is a MOS transistor having a source connected to the first node, a gate connected to the second node, and a drain connected to the ground voltage.

4. The voltage control circuit of claim 3, wherein the third transistor includes a plurality of bipolar transistors connected serially, each of the plurality of bipolar transistors being diode-connected in a forward direction.

5. The voltage control circuit of claim 1, wherein the fourth transistor is a bipolar transistor having an emitter connected to the first node, a base connected to the second node, and a collector connected to the ground voltage.

6. The voltage control circuit of claim 5, wherein the third transistor includes a plurality of bipolar transistors connected serially, each of the plurality of bipolar transistors being diode-connected in a forward direction.

* * * * *